United States Patent [19]

Villa

[11] 4,177,589

[45] Dec. 11, 1979

[54] THREE-DIMENSIONAL ANIMATED FACIAL CONTROL

[75] Inventor: Alvaro J. Villa, Northridge, Calif.

[73] Assignee: Walt Disney Productions, Burbank, Calif.

[21] Appl. No.: 841,002

[22] Filed: Oct. 11, 1977

[51] Int. Cl.[2] ..... G09F 27/00

[52] U.S. Cl. ..... 40/457; 40/416; 40/463; 46/118; 46/232

[58] Field of Search ..... 40/457, 455, 463, 906, 40/411, 416; 46/232, 118, 264; 35/17, 35 R, 35 A

[56] References Cited

U.S. PATENT DOCUMENTS

| | | | |
|---|---|---|---|
| 3,277,594 | 10/1966 | Rogers et al. | 40/457 |
| 3,298,130 | 1/1967 | Ryan | 46/118 |
| 3,699,707 | 10/1972 | Sapkus | 40/416 |
| 3,881,275 | 5/1975 | Baulard-Cogan | 46/118 X |
| 3,898,438 | 8/1975 | Nater et al. | 40/411 X |
| 3,912,694 | 10/1975 | Chiappe et al. | 46/232 |
| 3,931,679 | 1/1976 | Carter | 35/17 X |
| 4,107,462 | 8/1978 | Asija | 40/457X |

FOREIGN PATENT DOCUMENTS

| | | | |
|---|---|---|---|
| 1260142 | 1/1972 | United Kingdom | 40/416 |

*Primary Examiner*—John F. Pitrelli

*Assistant Examiner*—G. Lee Skillington

*Attorney, Agent, or Firm*—Fulwider, Patton, Rieber, Lee & Utecht

[57] ABSTRACT

An artificially animated face with three-dimensional facial features formed of a flexible material is provided with remotely actuable concealed mechanisms for manipulating the jaw, rounding the mouth, and drawing the lower lip inward relative to the upper lip. The face is operated by an audio input either from a microphone or from an audio tape. The audio input is fed both through an audio amplification system to a speaker located proximate to the face, and also to an audio encoder which senses the major frequencies of the spoken sounds of the audio input and produces one or more digital signals in response thereto. If an "F" sound is detected, the lower lip of the figure is drawn inward to a slight degree, thus simulating human lip movement in sounding the consonant "F". If the decoder detects an "O" sound, the mouth is rounded in response thereto. If the decoder detects an "A" sound, the mouth is drawn into a line. The eyes of the figure may be blinked upon receipt of a specified number of digital signals, and a wind jet may be operated in tandem with the mechanism for drawing the lower lip inward to simulate the expulsion of air from the mouth in conjunction with an "F" sound.

13 Claims, 4 Drawing Figures

THREE-DIMENSIONAL ANIMATED FACIAL CONTROL

BACKGROUND OF THE INVENTION

1. Field of the Invention

The present invention relates to the movement of artifically animated three-dimensional figures, and especially the simulation of human facial expressions in three-dimensional facial features.

2. Description of the Prior Art

Numerous systems have been employed to produce simulations of human facial expressions by animated figures. In this connection, a particularly life-like appearance is provided when the animated figure is equipped with facial features that move to simulate the movement of human facial features during speech with the concurrent provision of an audio output of actual or recorded human speech. In the past, however, the movement of animated facial features has imitated the corresponding facial movements of people to a very limited degree. Typically, the extent of speech simulation is the opening and closing of the jaw of a figure in synchronization with the playback of an audio recording.

Some attempts at greater sophistication have been implemented. For example, frequency filters have been employed in conjunction with two-dimensional facial animation to simulate lip movement on a cathode ray tube. In this connection, a combination of frequencies is sensed, and a two dimensional mouth may be rounded to simulate utterance of "O" and "U" sounds. Also, the upper and lower lips are moved apart a distance corresponding to the amplitude of the sound of human speech. However, no greater conformity of the movement of animated features to actual human facial movement has been achieved, and even the foregoing simulations have been imprecise because analog electrical signal filtration and amplification systems have been employed rather than the digital to analog conversion system of the present invention. Because of drift and instability in conventional analog systems, the detection of particular frequencies to produce a rounding of the mouth in two dimensional animated systems currently in use has been considerably inaccurate.

Other types of systems have attempted to produce facial movements corresponding to those of a human face during speech in three dimensions. However, such systems have been far from realistic in their simulation. One such arrangement attempts to move the upper and lower lips of a mannequin separately and in response to high or low frequency sounds. The upper lip may be connected to respond to of a high audio frequencies while the lower lip is designed to move in response to lower audio frequencies in order to produce a visual effect of distinguishing between the sounds of vowels and consonants. However, this movement represents only a vague approximation of human facial movement during speech, and is not convincingly realistic.

SUMMARY OF THE INVENTION

The present invention goes far beyond the degree of simulation of three-dimensional facial movement of a human face during speech than has heretofore been achieved. It is object of the present invention to manipulate the facial features of an artifical figure formed of a flexible material. Remotely actuable concealed devices are provided for manipulating opening and closing of the jaw, for rounding the mouth, and for drawing the lower lip of the mouth inward relative to the upper lip. This latter device is utilized in particular to mimic human facial movement in three dimensions by introducing translational movement of the lower lip relative to the upper lip of the face of the animated figure in a direction normal to the plane of the mouth. This feature is especially noticeable in causing the figure to shape its mouth for pronouncing a phonetic "F" sound. Heretofore, all relative movement in translation between the lips of a three-dimensional artifical figure has occurred incident to the rocking motion of the lower jaw of the figure in a hinged movement relative to a framework corresponding to the human skull. Heretofore animated figures have not previously exhibited realistic translational movement between their lips.

It is an object of the present invention to provide an artifically animated figure having a three-dimensional face with means for effectuating translational movement of the lips of the figure in a direction approaching and receding from a location corresponding to the neck of a human being. Relative translational movement of the lips is achieved in response to frequency filters which respond to the particular major frequencies of audible sounds of speech that are generated during the course of human speech by corresponding translational movement of the lips of a human being.

A further object of the invention is to effectuate control of the movement of facial features of an artifical figure using digital as well as analog electronic components. Digital transducers and decoders operate upon digital signals to eliminate errors due to gain fluctuations, drifting, aging of components, and other system inaccuracies that are characteristic of systems employing only analog circuitry. The digital encoding system of the present invention thereby is much more precise both in responding to the phonetic "F" sound by actuating the mechanism for inducing translational motion of the lips, and is similarly precisely responsive to "O" and "A" sounds to round the mouth of the figure and to draw the corners of the mouth apart respectively. In addition to enhancing precision of operation, the digital circuitry of the present invention operates with critical reductions in timing to allow spontaneous control of the figure from a microphone input. While able to operate from any type of audio input, such as an audio tape track to provide a prerecorded and preprogrammed response, as is conventional practice, digital control of the facial features of the animated figure is achieved so that spontaneous conversations can be carried on under the control of an operator speaking into a microphone input. This allows the invention to be used in a very sophisticated form of ventriloquism, in which a remotely located operator speaks into a microphone, and the three-dimensional facial features respond instantly synchronized with an audio output. The propogation delay in effectuating animation of facial features is so slight that the animated figure is able to appear to carry on conversations in an unprogrammed manner at typical conversational speeds.

A further object of the invention is to enhance realism of the mimicing figure in several other respects. Specifically, in one embodiment of the invention a low pressure air expulsion line is located within the head of the three-dimensional figure and connected for actuation in tandem with the device for effectuating translational motion of the lower lip relative to the upper lip.

The air expulsion device thereby expels a breath of air through the mouth of the face of the figure concurrently with an audible phonetic "F" sound which is also accompanied by corresponding translational movement of the lips of the figure.

Realism is enhanced still further by the digital control circuitry of the invention which causes the eyelids on the face of the figure to blink from time to time during the provision of an audio output and the corresponding movement of the facial features of the figure. A digital counter is connected to the output of one or more of the frequency discriminators to count output pulses. Upon reaching a predetermined count, the counter provides a signal to an actuator to cause the eyelids of the face of the figure to blink. The actuating signal to effectuate blinking is not provided as a regular, timed output, but rather occurs more frequently with certain frequencies of audio input. However, because the concert between movement of the eyelids and the audio frequency is rather complex, the eyes of the face of the figure appear to be blinking in random fashion, much as do the eyes of a human being.

The various features of the invention may be explained with reference to the accompanying drawings.

DESCRIPTION OF THE EMBODIMENT

Figure 1:
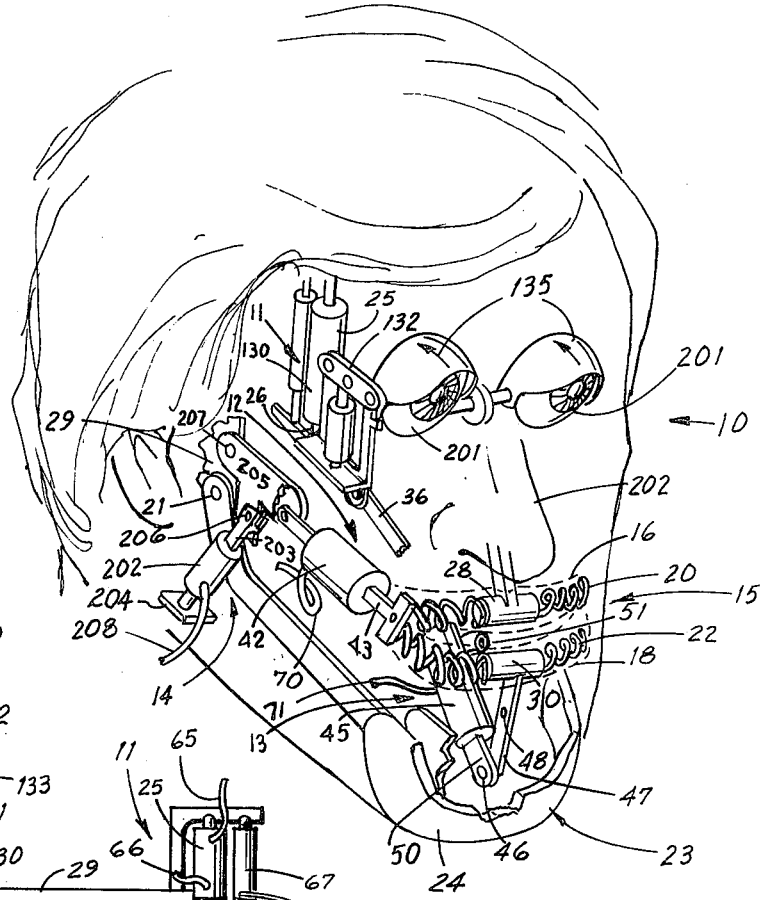
FIG. 1 is a perspective view illustrating the mechanical components for movement of the facial features of an animated figure.

FIG. 1 illustrates a perspective view of a replicia of a face 10 having three-dimensional features and formed of a flexible material, such as polyvinyl chloride plastic. The face 10 is illustrated mostly in transparent form in FIG. 1 to allow the interior mechanisms of the invention to be viewed. However, it is to be understood that only the facial features of the face 10 are apparent to an observer. The face 10 has remotely actuable concealed devices for manipulating the jaw, indicated generally at 11, means for rounding the mouth, indicated generally at 12, means for stretching the mouth, indicated at 14, and means for drawing the lower lip inward relative to the upper lip of the figure, indicated generally at 13.

Figure 2:
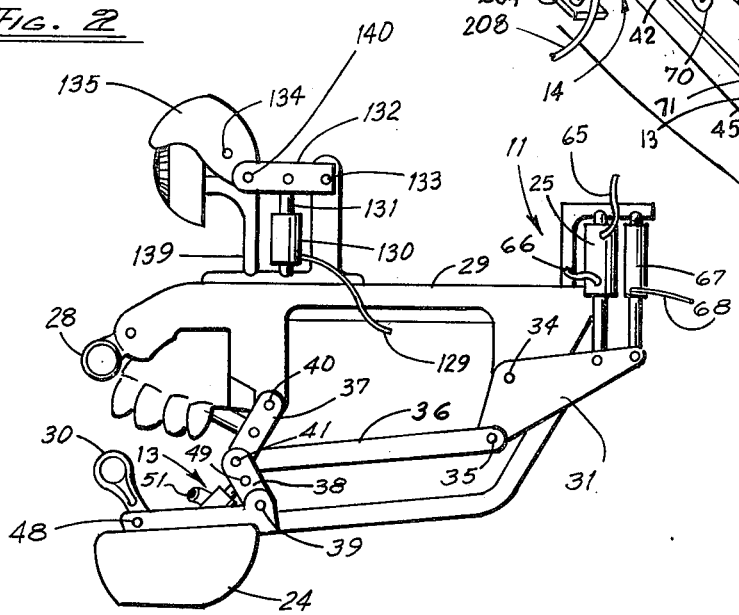
FIG. 2 is a side elevational view from the left of a portion of the mechanical apparatus for manipulating the jaw and eyelids of the face of FIG. 1.

The features of the face 10 include a pair of eyes 201 a nose 202, a mouth 15 and a chin 23. An upper lip 16 and a lower lip 18 are formed in a mold and melted onto upper and lower coil springs 20 and 22 respectively to form the mouth 15. Below the mouth 15, the chin 23 is moved by a jaw 24 mounted in hinged fashion to rotate about pins 21 located on either side of the head near the rear of the face 10 at a position corresponding to the base of a skull of a human being. The jaw 24 is moved up and down to open and close the mouth 15 by the action of a pneumatic servo cylinder at 25 vertically aligned at a location corresponding approximately to the rear of a skull of a human being and attached at its upper extremity securely to the framework 29. The cylinder 25 has a piston or activator 26 pivotally connected to a bell crank 31, as depicted in FIG. 2.

Bell crank 31 is rotably mounted to the supporting frame 29 for the face 10 at a pin 34, and includes another rotatable connection at 35 from which a push rod 36 extends longitudinally forward in a position corresponding to the mouth cavity of a human being. A scissor linkage having an upper link 37 and a lower link 38 is attached to the jaw 24 by a rotatable connection 39 and to the fixed framework 29 for the face 10 at a rotatable connection 40. The opposing links 37 and 38 are rotatably connected together by a short transverse, horizontal rod 41, which also serves as the attachment point for the push rod 36. Movement of the activator rod 26 operates the bell crank 31 to move the push rod 36 forward and backward within the mouth cavity of the face. This causes the opposing legs 37 and 38 to alternatively spread or fold together. Since the link 37 is connected to the fixed framework 29 for the face 10, the lower jaw 24 is carried in relative movement with respect to the remaining portion of the face 10 by rotation about the pins 21 located at the rear of the head of the figure.

It should be noted that a pair of sleeves 28 and 30 are provided and are respectively connected to the framework 29 of the face 10 and to the movable lower jaw 24. The coil springs 20 and 22 respectively pass through the sleeves 29 and 30 to cause the lips 16 and 18 to open and close with the movement of the jaw 24.

The mechanism 12 for rounding the mouth includes a pair of digitally operated pneumatic valves 42 having activator rods 43 reciprocal therein. The valves 42 are positioned on either side of the face 10 in generally horizontal fore and aft alignment at approximately the cheek level of the face 10. For the sake of clarity, only one of the mechanisms 12 is depicted in FIG. 1. The cylinder 42 is connected to one leg of a generally T-shaped link 205, while the actuator rod 43 is connected to grasp the terminal ends of the coil springs 20 and 22 at the corners of the mouth 15.

It can be seen that when the mouth opening mechanism 11 is activated to part the lips 16 and 18, and when the activator rods 43 are concurrently extended forward to release tension on the springs 20 and 22, the mouth 15 becomes rounded, thus assuming a mouth configuration simulating the shape of the mouth of a human being pronouncing an "O" sound.

The mechanism 14 for stretching the mouth 15 is operated to correspond to the movement of a human mouth in pronouncing "A" sounds. The mechanism 14 includes another pneumatic cylinder 202 anchored at its longer end to the frame 29 by means of a bracket 204. Extending upward and slightly forward, a piston rod 203 working within the cylinder 202 is connected to another leg of the T-shaped link 205 at a rotatable connection 206. The final leg of the T-shaped link 205 is connected to the framework 29 of the face 10 at a rotatable connection at 207.

In response to a phonetic "A" sound, a pneumatic pressure is applied through the air connection line 208 to the cylinder 202. This forces the piston rod 203 upward rotating the T-shaped link 205 rearward about the rotatable connection to the framework 29 at 207. This rotation of the T-shaped link 205 draws the entire cylinder 42 and actuator rod 43 associated therewith rearward, thereby drawing the terminal ends of the springs 20 and 22 rearward where they are attached to the corners of the mouth 15. This action stretches the mouth 15 as occurs in the face of a human being pronouncing sounds of the letter "A". It should be noted that the same mechanism 14 can be used to draw the mouth 15 of the face 10 into a smile. Operating the mouth 15 to smile however, is normally not performed in response to an audio input, but rather is typically under the control of a program tape or a computer.

The lip translational mechanism 13 includes another digitally operated pneumatic cylinder 45 positioned generally at a location corresponding to the location of the tongue of an individual. The upper end of the pneumatic cylinder 45 is secured to the lower leg 38 of the scissors linkage at a rotation pin 49. The cylinder 45 slopes downward and forward, and an actuator rod 50 reciprocally mounted therein extends to a rotable connection at 46, where it is linked to a lever 47 which extends upwardly and forwardly. Lever 47 is rotatably mounted in it midsection about a transverse axle 48 which is secured into position relative to the jaw 24. The upper and forward extremity of the lever 47 carries the sleeve 30 which, in turn, entraps the coil spring 22 that is buried in the lower lip 18. It can be seen from FIG. 1 that extension of the actuator rod 50 from the pneumatic cylinder 45 rocks the lever 47 about the axle 48, thereby drawing the sleeve 30 inward relative to the sleeve 28. When manipulated in this manner, the lip translation mechanism 13 draws the lower lip 18 inward relative to the upper lip 16, thus simulating in three dimensions the configuration of the lips of an individual speaking the phonetic sound of the letter "F".

A low pressure air expulsion nozzle 51 is located adjacent to the cylinder 45 and directed outwardly toward the opening between the lips 16 and 18, as depicted in FIGS. 1 and 2. The nozzle 51 is operated in tandem with the cylinder 45 which draws the lower lip inward relative to the upper lip 16. The nozzle thereby expels a breath of air through the mouth 15 of the face 10 concurrently with an audible phoentic "F" sound, which is also accompanied by corresponding translational movement of the lips 16 and 18.

A further feature of the invention is a system for causing the eyelids 135 of the animated face 10 to blink in apparent random fashion. Passage of air through line 129, depicted in FIG. 2, extends the activator arm 131 from the cylinder 130, to rotate levers 132 clockwise on either side of the face 10 about rearward connections 133 which are secured to posts 137 extending upward from the framework 29 of the face 10. A pair of hoods 135 serving as eyelids are coupled for rotation together about a transverse axis and are rotatable at connections 134 about upright stanchions 139 mounted on the face framework 29. The levers 132 are coupled to operate in tandem under the control of the activator arm 131 and are connected to the corners of the eyelids 135 at rotatable connections 140. Clockwise rotation of the lever 132 in FIG. 2 acts to rotate the eyelids 135 in a counterclockwise direction about the connections 134, which serve as fulcrums secured to the framework 29 of the face 10. The hoods 135 simulate eyelids in appearance and thus are rotated downward each time the activator rod 131 is extended upward from the cylinder 130.

Figure 3:
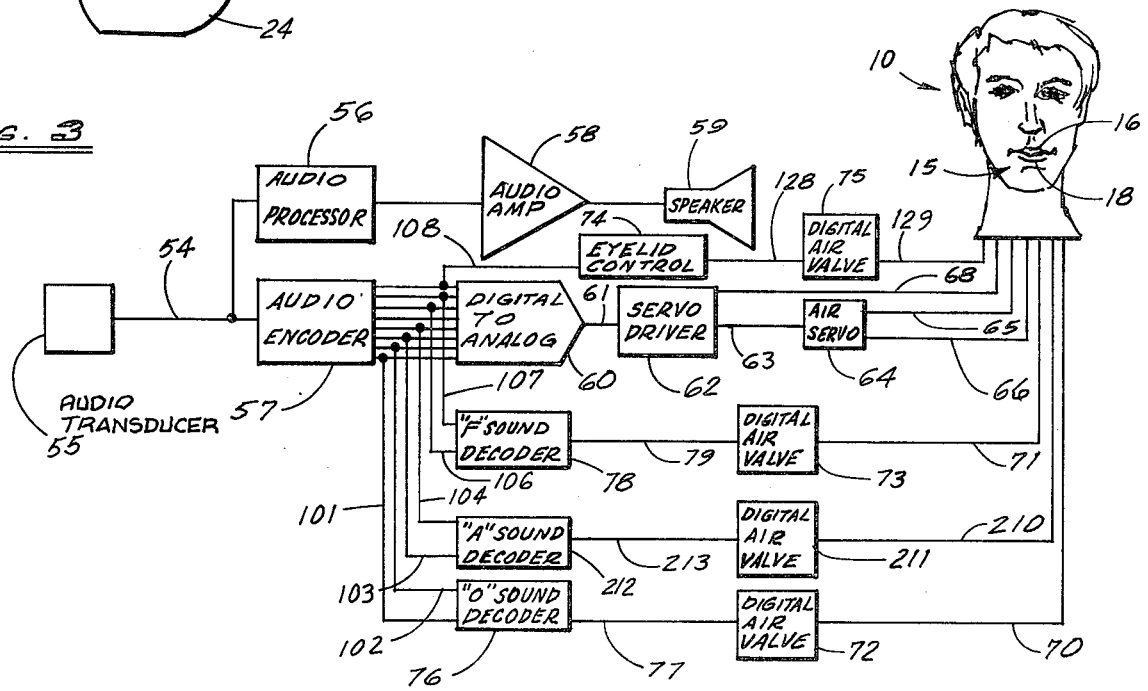
FIG. 3 is a block diagram illustrating the electrical components of the invention.
Figure 4:
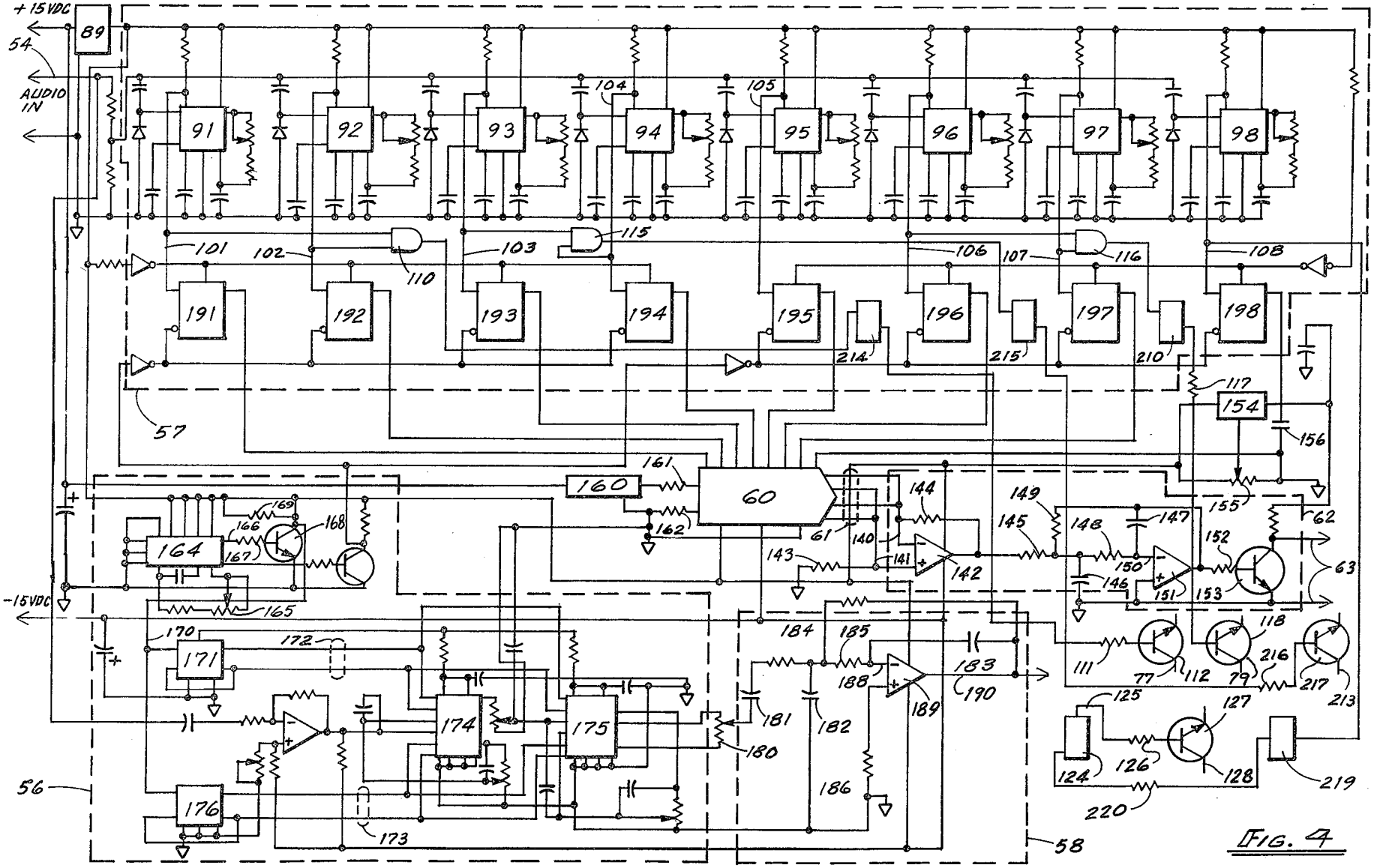
FIG. 4 is a schematic diagram illustrating a portion of the circuitry of FIG. 3.

The electrical control of the facial feature manipulating elements depicted in FIGS. 1 and 2 is illustrated in FIGS. 3 and 4. With particular reference to FIG. 3, an audio transducer is illustrated at 55, and may take the form of an input from an audio tape track, a tape recorder, or it may be a microphone into which a ventriloquist speaks. The audio transducer 55 generates an electrical signal of variable frequency proportional to the frequency of an audible input, that is an input within the range of the human voice which extends from about 200 hertz to maximum of four kilohertz.

The electrical signal provided by the audio transducer 55 is transmitted via line 54 to audio processing circuitry 56 and to an audio decoder depicted at 57. The audio processor 56 includes a delay circuit which may be varied and which serves to allow synchronization of audio output through an amplification system 58 to a speaker 59 located in or near the animated face 10.

The audio decoder includes a plurality of frequency discriminators. Each of these provides a digital output upon detecting different frequency components from the transducer 55 in the audio signal on line 54. Each of the frequencies detected corresponds to a different audible frequency or frequency band within the range of the human voice. A decoder 60 receives the digital inputs from the frequency discriminators of the encoder 57, and in response thereto provides an analog output at 61. This output is proportional to the degree to which it is desired to open the mouth 15 of the head 10 utilizing the jaw manipulating mechanism 11. The analog output at 61 is operated through a servo driver 62 to provide a command signal at 63 to a pneumatic servo mechanism 64. The servo mechanism 64 has two pneumatic lines 65 and 66 which are connected to the pneumatic servo cylinder 25 of FIGS. 1 and 2 to open and close the mouth 15. An electrical feedback signal from a linear voltage differential transducer (LVDT) transformer 67 is arranged in parallel for tandem operation with the cylinder 25 and the piston actuator 26 to provide an electrical feedback on line 68 to the servo driver 62 to control the degree to which the jaw 24 moves relative to the framework of the face 10 about the hinging pins 21. The LVDT transformer 67 employs an a.c. coil within which a slug or core reciprocates in tandem with the piston 26 in the cylinder 25. The degree to which the core resides within the coil determines the magnitude of output on line 68.

It can be seen that the pneumatic servo cylinder 25 is an analog servo mechanism which receives pneumatic inputs at 65 and 66 which are controlled through an air servo mechanism 64 both in response to the electrical feedback signal 68 and by the analog output 61 of the decoder 60. The mouth rounding mechanism 12, the mouth stretching mechanism 14, and the lip translational mechanism 13, on the other hand, are not analog operated devices, but instead are digitally activated. That is, when enabling signals are provided, the activator piston rod 50 of the cylinder 45, the activator piston rod 203 of the cylinder 202 and the activator piston rod 43 of the cylinder 42 are extended or retracted a fixed, predetermined distance. The signals to the cylinder 42 to effectuate movement of activator rod 43 are provided by a pneumatic line at 70. The signals to the cylinder 202 to reciprocate the piston 203 are passed on a pneumatic line 208 while the signals to move the activator rod 50 relative to cylinder 45 are provided by a similar pneumatic line 71. Pneumatic line 71 includes a tandem connection to also expel air through the nozzle 51. The pneumatic lines 70, 208 and 71 are operated by digital air valves 71, 211 and 73 respectively, which in turn derive enabling inputs from the audio decoder 57. The mouth rounding mechanism 12 is activated in response to signals on lines 101 and 102 to a decoder 76 which detects the occurrence of particular frequencies associated with the sounds of the letters "O" and "U" to provide an output at 77 to the digital air valve 72. The mouth stretching mechanism 14 responds to signals on lines 103 and 104 to a decoder 212 to detect the occurrence of particular frequencies, characteristic of sounds of the letter "A" to provide an electrical output signal on line 213. Similarly, an "F" sound decoder 78 provides a digital output at 79 indicative of the occurrence of particular audio frequencies as provided at inputs 106 and 107 by the audio decoder 56. The eyelid control device 74 obtains an input on line 108 from one of the frequency discriminators of the audio decoder 57 to cause the lids on the eyes 201 of the animated figure to blink in apparent random fashion. Eyelid control is effectuated through another digital air valve 75.

FIG. 4 depicts the audio processor 56, the audio amplification system 58, the audio decoder 57, the digital to analog decoder 60, the decoders 76, 212 and 78, and the eyelid control 74 in some detail.

A five volt voltage supply is provided from a 15 volt D.C. source by a voltage regulator 89 to eight different frequency discriminators indicated at 91 through 98 in FIG. 4. Each of the discriminators 91 through 98 is a general purpose tone decoder designed to provide a saturated transistor switch to ground when an input signal is present within the frequency pass band. One typical circuit which can be employed for this purpose is manufactured by National Semiconductor Corporation and sold as the model LM-567 tone decoder. Each of the tone decoders 91 through 98 is adjusted to pass a particular frequency and provide outputs on corresponding lines 101 through 108 when those frequencies are sensed.

It must be understood that there is a certain amount of variation among individual people insofar as the frequencies which comprise the phonetic sounds of their speech are concerned. For this reason, for optimum performance the tone decoders 91 through 98 should be tuned to the voice of a particular individual whose voice is used as the audio input on line 54. However, one exemplary tuning of the tone decoders 91 through 98 which may be employed is set forth below in Table I.

TABLE I

| TONE DECODER | FREQUENCY (kHz) |
|---|---|
| 91 | 0.43 |
| 92 | 0.50 |
| 93 | 0.70 |
| 94 | 0.75 |
| 95 | 1.40 |
| 96 | 2.50 |
| 97 | 3.30 |
| 98 | 3.50 |

The above frequencies each represent the center frequency of a broad or narrow band of frequencies, and are used as shorthand descriptions of the entire frequency band associated with the related tone decoder.

The outputs of the tone decoders 91 through 98 appear respectively on lines 101 through 108. To activate the pneumatic cylinder 42, the outputs 101 and 102 are coupled together through an AND gate 110 which in turn is coupled to a monostable multivibrator 214. The multivibrator 214 generates a pulse of fixed length so that "O" sounds which would other wise be too brief to activate the system are held and transmitted through a resistor 111 to the base of a Darlington power transistor 112. The collector of the power transistor 112 is connected on line 77 to a solenoid (not shown) which opens the air valve 72 to allow air to enter pneumatic line 70 to extend the activator rod 43 from the cylinder 42. The output lines 101 and 102 from the tone decoders 91 and 92 thereby represent the occurrence of frequencies of for example, 340 hertz and 500 hertz. These are major frequencies which occur during an oral pronounciation of phonetic sounds of the letter "O". When "O" sounds occur, the mouth 15 will become rounded since, concurrently with release of tension on the springs 20 and 22 by the cylinder 43, the cylinder 25 will be activated to open the mouth 15.

Similarly, the output lines 103 and 104 are coupled together through an AND gate 115, the output of which is connected through a nonostable multivibrator 215 to a resistor 216. The resistor 216 is connected to the base of another Darlington power transistor 217, the collector of which is connected on line 213 to a solenoid (not shown) to operate the valve 211 to provide pressure through the pneumatic line 210. This extends the piston rod 203 from the cylinder 202. In this way, the occurrence, of frequencies of, for example, 700 and 2000 cps, which are characteristic of the phonetic sounds of the letter "A" activate the power transistor 217 to cause air to be emitted to the cylinder 202 through pneumatic input line 208 to extend the activator piston rod 203 from the cylinder 202 to rotate the T-shaped link 205 and draw back the corners of the lips 16 and 18. The occurrence of the sound of the letter "A" thereby causes the mouth 15 of the face 10 to be stretched and opened slightly, since, concurrently with the activation of cylinder 202, the lips 16 and 18 will be vertically separated from each other by virtue of actuation of the cylinder 25.

In a similar manner, the output lines 106 and 107 from the tone decoders 96 and 97 are coupled together through an AND gate 116 and through a monostable multivibrator 210 resistor 117 to another Darlington power transistor 118. The collector of transistor 118 is connected by line 79 to the coil of a different solenoid (not shown) which, when actuated, emits air on pneumatic input line 71 to the pneumatic cylinder 45. The admission of air to cylinder 45 causes the activator rod 50 to be extended. This pivots the lever 47 about the transverse axis 48 causing the sleeve 30 to be drawn inward relative to the sleeve 28. The effect is to draw the lower lip 18 of the animated face 10 inward relative to the upper lip 16.

The AND gate 110 together with the monostable multivibrator 214, the resistor 111 and the transistor 112 in FIG. 4, forms the "O" sound decoder 76 in FIG. 3. Likewise AND gate 115, monostable multivibrator 215, resistor 216, and transistor 217 form the "A" sound decoder while the AND gate 116, monostable multivibrator 210, the resistor 117 and the transistor 118 in FIG. 4 form the "F" sound decoder 78 in FIG. 3. While all of the tone decoders should be tuned to the voice of the person or a sound track which is to activate movement of the face 10, proper adjustment of the tone decoders in the upper frequency range is particularly important. The tone decoders 96 and 97 may be adjusted as necessary in order to respond to a phonetic "F" sound by the activating voice. Adjustment of the tone decoder 96 typically is within the range of 1.4 to 3.0 kilohertz while the tone decoder 97 may typically be adjusted between 1.5 and 3.5 kilohertz.

A further feature of the invention is the provision of a system for causing the lids of the eyes to blink in apparent random fashion. The eyelid control 74 includes a seven bit binary counter 124 which is connected to the output line 108 of the tone decoder 98.

The decoder 98 is set for an upper frequency in the audible range. Since these higher frequencies do not occur as often as the lower frequencies, outputs on line 108 will occur less frequently than outputs from the tone decoders set for lower frequencies, such as the tone decoders 91 and 92. For this reason, it will take some time for the counter 124 to fill, perhaps several seconds during continuous speech. Of course, when there is no audio input on line 54, the counter 124 will not increment at all.

The output on line 108 is connected to a monostable multivibrator 219 which in turn provides pulses through a resistor 220 to a counter 124. When the counter 124 is filled at the conclusion of 128 counts, the overflow output line 125 carries a signal through a resistor 126 to the base of another Darlington power transistor 127. The collector of the transistor 127 is connected by line 128 to another solenoid (not shown) which in turn causes the digital air valve 75 to open momentarily to connect a pneumatic source to line 129 which leads to the pneumatic cylinder 130 in FIG. 2.

The hoods, or eyelids 135 thereby blink upon the actuation of cylinder 130 which occurs with each overflow of the counter 124. The realism of facial movements of the face 10 is thereby enhanced even further, since the face 10 appears to blink its eyes 12 from time to time. The blinking is dependent upon the occurrence of high frequency sound which are detected by the tone decoder 98, the rate occurrence of which will vary throughout the course of speech. The eyes 12 thereby appear to blink in a random fashion, similar to blinking of the eyes of a human being, and not cyclically or at predetermined intervals of time.

The outputs 101 through 108 of the tone decoders 91 through 98 are all connected through corresponding flip-flop circuits 191–198 as inputs to a companding digital to analog converter 60. Although the flip-flops 191–198 are not absolutely necessary, they are sometimes useful to hold the signals from the tone decoders 91–98 long enough for the digital to analog converter to effectuate proper decoding. In some applications the flip-flops are not necessary. The particular combination of tone frequencies detected by the converter 60 determines the magnitude of outputs on lines 140 and 141 to opposing inputs of an operational amplifier 142. The positive input to operational amplifier 142 on line 141 is grounded through a resistor 143. A feedback resistor 144 is interposed between the output of amplifier 142 and the negative input line 140. The output of operational amplifier 142 varies from zero to ten volts and is passed through a resistor 145 and through a smoothing network including capacitors 146 and 147 and resistors 148 and 149. The smoothed signal appears on line 150 as an input to the negative terminal of another operational amplifier 151. The output of amplifier 151 is connected through a resistor 152 to the base of a transistor 153, the emitter and collector of which are connected on lines 63 to the servo driver 62 in FIG. 3. A voltage regulator 154 and an adjustable resistor 155, along with a capacitor 156 help to stablize the output to the servo driver 62.

As previously noted, the signals on lines 63 operate the air servo mechanism 64 to control the flow of air to the cylinder 25 through the airlines 65 and 66. This in turn controls movement of the jaw 24 so that the face 10 appears to be speaking upon the occurrence of an audio encoded electrical signal on line 54, and opens its mouth as determined by the decoder 60 in accordance with the frequencies sensed. For example, when the frequencies of a phonetic "O" sound are sensed by the tone detectors 91 and 92, a large signal will appear on line 141, thereby causing the mouth to open a considerable distance. When frequencies associated with pronunciation of a phonetic "F" sound occur and are detected by the tone detectors 96 and 97, a signal will appear on the line 140 which will cause the mouth 15 to open only slightly.

The digital to analog converter 60 may be programmed as desired to accomodate the frequencies characteristic to the speech of a particular person. The converter 60 is connected to a positive 15 volt D.C. power supply through a voltage regulator 160 and a resistor 161. A resistor 162 is connected to ground. A suitable digital to analog converter which may be employed is the model DAC-76 which is manufactured by PMI.

The audio processor 56 and the audio amplifier 58 are also depicted in detail in FIG. 4. The audio amplifier 56 includes a one shot multivibrator 164 which works as a free running oscillator. A variable resistor 165 is used to adjust the frequency of clock pulses appearing at output line 166. The output 166 is connected through a resistor 167 to the base of a transistor 168, the collector of which is connected through a resistor 169 to the positive five volt D.C. power supply source. Line 170 carries the clock pulses to a pair of timing flip-flops 171 and 176 which divide the frequency of the one shot 164 in half. The flip flop outputs 172 and 173 are connected to a pair of audio delay circuits 174 and 175, the purpose of which is to delay the audio input from line 54 to allow time for the devices for effectuating facial movement to be operated in synchronization with the audio output of the speaker 59. The delay circuits 174 and 175 are series connected together to achieve a total delay of from 50 to 300 milliseconds. While the most desirable delay will vary with pneumatic cylinder and mechanical components, a 180 millisecond delay provides sychronization between facial movement and audio output in a preferred embodiment of the invention.

The output of the audio processor 56 appears at an adjustable resistor 180 which is connected to a low pass filter network including capacitors 181, 182 and 183 and resistors 184, 185 and 187. The output line 188 of the low pass filter is provided to the negative input of an operational amplifier 189 which both amplifies the audio signal and rolls off high frequency noise. The positive input to amplifier 189 is connected to ground through a resistor 186. The output of amplifier 189 appears at 190 as an input to the speaker 59 in FIG. 3.

In the operation of the invention, an audio input on line 54 from an audio input device 55 is directed both to the audio encoder 57 and to the audio processor 56. In the audio processor 56, a delay is introduced into the audio signal by the delay circuits 174 and 175. After the appropriate delay, the audio signal is filtered and provided as an audio output to the speaker system 59. During the delay interval, the tone detectors 91 through 98 detect various audio frequencies associated with the pronunciation of particular oral sounds. The outputs of the tone detectors 91 through 98 are decoded in a decoding digital to analog converter circuit 60 to control the degree to which the cylinder 25 moves the jaw 24 relative to the framework 29 of the face 10. This in turn controls the degree to which the lips 16 and 18 separate to simulate the movement of the human jaw during speech.

The mouth is rounded in response to an audio input on line 54 containing frequencies characteristic of "O" sounds and the corners of the mouth 15 are drawn back in response to "A" sounds. Such sounds are detected by the tone detectors 91 and 92 and 93 and 94 respectively. The occurrence of an "O" sound results in an output from AND gate 110 which operates a solenoid to provide air to the cylinder 142 through a pneumatic input line 119. The activation of the pneumatic cylinder 142 extends the activator rod 43 to release tension on the coil springs 20 and 22 to allow the corners of the mouth 15 to be drawn together as the mouth opens under the control of the pneumatic servo cylinder 25. This concert of operation between the pneumatic cylinder 142 and of the pneumatic servo cylinder 25 separates the lips 16 and 18 and rounds the mouth 15 of the face 10. In response to an "A" sound, however, a solenoid provides air on line 208 to the pneumatic cylinder 202. This extends piston rod 203 and rotates the T-shaped link upward and backward, thereby drawing the mechanism 12 rearward, thus increasing tension on the springs 20 and 22. This causes the lips 20 and 22 to stretch while the cylinder 25 opens the mouth somewhat. This combination of movements draws the mouth into a configuration closely resembling that of a human being voicing "A" sounds.

Whenever a phonetic "F" sound occurs, the tone decoders 96 and 97 pass a signal through the AND gate 116 which in turn provides a pneumatic input on line 71 to the pneumatic cylinder 45. This rotates the lever 47 about the axle 48 pushing the lower portion of the lever toward the chin 23 and drawing the upper portion of that lever inward. Attached to the upper portion of lever 47 is the sleeve 30. Movement of the sleeve 30 inward relative to the sleeve 28 causes the lower lip 18 to be drawn inward relative to the upper lip 16 of the face 10. In addition, the pneumatic input on line 71 is directed through a tandem connection to the nozzle 51 to expel a breathe of air through the mouth 15.

During the course of speech, high frequencies will occur from time to time which will activate the tone decoder 98 to provide an output to the counter 124. Upon overflow of the seven bit counter 124 after 128 pulses, the pneumatic line 129 is momentarily opened to activate the pneumatic cylinder 130. This causes the lids 135 of the eyes 12 to blink. After each overflow, the counter 124 is reset to zero and begins counting again.

While but a single embodiment of the invention has been depicted, it should be understood that numerous variations and alternative forms of the invention will readily occur to those familiar with the animation of artifical figures. For example, while a human face has been depicted in the drawings, replicas of faces of other creatures can likewise be manipulated to simulate human facial expressions. Accordingly, the invention should not be considered as limited to the particular embodiment depicted herein, but rather is defined in the claims appended hereto.

I claim:

1. An artifically animated figure comprising:

a replica of a face having three-dimensional facial features formed of a flexible material and having remotely actuable concealed means for manipulating the jaw, concealed means for rounding the mouth, concealed means for stretching the mouth and concealed means for drawing the lower lip inward relative to the upper lip, and audio transducing means for generating an electrical signal of variable frequency components proportional to the frequency components of an audible input and coupled to said concealed means for actuating selected combinations of said concealed means as controlled by said electrical signal to produce animated movements of said facial features corresponding to facial movements of an individual originating said audio input.

2. An animated figure according to claim 1 further comprising a plurality of frequency discriminators each providing an output upon receipt of different frequency components in said electrical signal corresponding to different audible frequencies, and separate actuating means associated with at least one of said concealed means and connected to receive actuating signals indicative of outputs of specific combinations of ones of said frequency discriminators.

3. An animated figure according to claim 2 further comprising a digital to analog converter connected to receive the outputs of all of said frequency discriminators to provide an actuating signal of variable magnitude to said means for manipulating the jaw.

4. An animated figure according to claim 1 further comprising:

means responsive to frequency components of said electrical signal corresponding to the frequency of the audible spoken sound of the letter F to actuate said concealed means for drawing the lower lip inward relative to the upper lip.

5. An animated figure according to claim 4 further comprising low pressure air expulsion means located within said head and connected for actuation is tandem with said concealed means for drawing the lower lip inward relative to the upper lip to expel a quantity of air through the mouth of said head.

6. An animated figure according to claim 1 further comprising:

means responsive to frequency components of said electrical signal corresponding to the frequency of the audible spoken sounds of the letter O to actuate said concealed means for rounding the mouth.

7. An animated figure according to claim 1 further comprising:

means responsive to frequency components of said electrical signal corresponding to the frequency of the audible spoken sounds of the letter A to activate said concealed means for stretching the mouth.

8. Apparatus for simulating human facial movements in synchronization with audio voice reproduction comprising:

a replica of a face having three-dimensional facial features formed of a flexible material and having selectively actuable concealed means for moving the jaw, means for rounding the mouth, means for stretching the lips and means for drawing the lower lip inward, relative to the upper lip, an audio input for generating an electrical signal having a plurality of frequency components corresponding to frequency components of human speech, and means to ascertain particular frequencies in the electrical signal and if said particular frequencies are ascertained, means to use that particular frequency portion of the signal to actuate selectively said concealed means.

9. Apparatus according to claim 8 wherein said transducer means further comprises frequency discrimination means for detecting the occurrence of frequency components of said electrical signal corresponding to audible frequency components of the sound of the spoken letter F to actuate said concealed means for drawing the lower lip inward relative to the upper lip.

10. Apparatus according to claim 8 wherein said transducer means further comprises frequency discrimination means for detecting the occurrence of frequency components of said electrical signal corresponding to audible frequency components of the spoken letter O to actuate said concealed means for rounding the mouth.

11. Appáratus according to claim 8 wherein said transducer means further comprises frequency discrimination means for detecting the occurrence of frequency components of said electrical signal corresponding to audible frequency components of the spoken letter A to actuate said concealed means for stretching the lips.

12. Apparatus according to claim 8 further comprising concealed means for blinking the eyelids of said replica during the generation of said audio electrical signal.

13. Apparatus according to claim 12 further comprising frequency discrimination means each providing an output upon receipt of different components in said electrical signal, and counting means connected to at least one output of said frequency discrimination means and actuating means for said eyelids connected to said counting means to effectuate blinking upon receipt of a predetermined number of cummulative outputs from said frequency discrimination means.

* * * * *